US005660137A

United States Patent [19]

Manley

[11] Patent Number: 5,660,137

[45] Date of Patent: Aug. 26, 1997

[54] DETACHABLE PROTECTIVE DINGHY COVER

[76] Inventor: Frank C. Manley, 4125 Ryland Dr., Broadview Heights, Ohio 44147

[21] Appl. No.: 585,037

[22] Filed: Jan. 11, 1996

[51] Int. Cl.[6] ..... B63B 17/00

[52] U.S. Cl. ..... 114/361

[58] Field of Search ..... 114/361, 343, 114/211, 221 R; 135/88, 88.01, 88.02, 88.03, 88.05, 88.06, 116

[56] References Cited

U.S. PATENT DOCUMENTS

| | | | |
|---|---|---|---|
| 3,955,228 | 5/1976 | Gaschenko et al. | 114/361 |
| 4,593,641 | 6/1986 | Adams et al. | 114/361 |
| 4,671,203 | 6/1987 | Sanburg | 114/361 |
| 4,683,900 | 8/1987 | Carmichael | 114/361 |
| 5,394,822 | 3/1995 | Worland | 114/361 |

*Primary Examiner*—Stephen Avila
*Attorney, Agent, or Firm*—Joseph H. Taddeo

[57] ABSTRACT

The present invention relates to a detachable and removable cover to protect the interior and contents of a dinghy, small fishing boats, small jet boats and the like. It is designed to conform to the shape of the dinghy to provide full closure about the dinghy to prevent a safer and more secure fit. The cover is made of a semirigid rubberized injection molded vinyl plastic that resists degradation when exposed to ultraviolet radiation. Integrally molded handles and tie-downs provide a one-piece construction that is economical to produce. Positioning of the handles gives the user a well-balanced placement that allows ease of handling.

31 Claims, 3 Drawing Sheets

DETACHABLE PROTECTIVE DINGHY COVER

FIELD OF INVENTION

The present invention relates to a detachable and removable cover to protect the interior and contents of a dinghy, small fishing boats, small jet boats and the like.

BACKGROUND OF THE INVENTION

A dinghy is (1) a small rowboat, (2) an inflatable rubber life raft, or (3) a small open boat carried as a tender, lifeboat, or pleasure craft on a larger boat.

The term dinghy is applied to various small boats, including ship's boats or tenders, racing sailboats, and passenger craft. The dinghies that serve as ship's boats were originally rowboats with a transom (flat) stern, a rounded bow, and two to four oars, but now are usually powered and have a pointed bow. A small open sailboat, used as a tender and lifeboat for a yacht, is also referred to as a dinghy, as is an inflatable life raft. Racing dinghies are equipped with a sail and rudder and sometimes a centerboard.

U.S. Pat. No. 5,228,408, granted Jul. 20, 1993, to T. L. Jannausch, discloses a reusable tarpaulin protective cover that is mounted to a boat, which is supported for drainage and provides protection against winds and storms.

U.S. Pat. No. 5,027,739, granted Jul. 2, 1991, to M. S. Lackovic, details a hatchway protective cover for a boat, that is fashioned from a trapezoidal shaped sheet of flexible material, of which a portion is transparent.

U.S. Pat. No. 4,768,437, granted Sep. 6, 1988, to F. L. Jones, describes an inflatable boat cover comprised of a flexible sheet material. The cover is a covering for an opening, such as a cockpit or hatchway and is easily stored when deflated.

U.S. Pat. No. 4,363,284, granted Dec. 14, 1982, to W. E. Monroe, teaches of a dock side protective cover made of a flexible skirt.

U.S. Pat. No. 4,075,723, granted Feb. 28, 1978, to M. A. Bareis, et al, discloses a boat cover of a flexible sheet material and a flexible resilient rib adapted to extend in an arched configuration from forward to aft for supporting the cover.

U.S. Pat. No. 3,748,671, granted Jul. 31, 1973, to G. Dusmet, describes an inflatable boat cover for pneumatic boats that is suitable to allow the boat to be towed in its capsized position.

The above referenced patents use tarpaulins or fabric materials to act as protective covers. There may be occasions where these covers may stretch, and tear or rip if caught in a gust of wind. Also, exposure to direct sunlight may in time cause the fabric to degrade where pinholes can develop and water seepage damages the contents of the boat. Still anther problem that exists for those referenced is where water may collect in the recesses causing further damage over time. Even though a resilient rib may be used to tauten the material, frequent use may stretch the fabric to the point where small tears or rips may develop at the high stress wear points.

These objections can be overcome by the present invention that will be disclosed in the following paragraphs.

What is needed is durable boat cover that is fashioned into a durable semirigid but pliable structure that is safe and reliable and can be easily managed into position by one person. In this regard, this invention fulfills this need.

SUMMARY OF THE INVENTION

The present invention in its preferred embodiment relates to a one-piece designed protective cover for a small water craft, such as a dinghy that is constructed of a semirigid rubberized injection molded vinyl. A one-piece design provides ease of handling and storage even by one person. Included in the integrated cover design are convenient handles and tie-downs that are molded into the cover.

The cover is shaped so that water can easily run off and not be stored in pockets that can capture and stagnate the water. There is no pocketing of water that occurs as from fabric material type covers. The cover is shaped to assist in reducing any swamping that may tend to occur while under tow.

In the preferred embodiment, the cover tightly covers the craft in a form fitting design. The outer cover walls provide a functional fit to form essentially a watertight cover. Each of outer cover walls fit snugly around the outside shell of the dinghy.

It is designed to be an elongated pyramidoidal shape of six intersecting planes, where each of the six planes converges at the apex of the tent like structure. The planes are essentially flat and meet at an elevated center to form a streamlined cover. There is sufficient incline to the aft plane to accommodate an outboard motor.

The tent like shape also provides protection from snow and ice, especially during storage where inclement weather dominates the scene. The formation of ice can be especially damaging to the dinghy particularly in its expansion phase.

The dinghy cover is designed to be constructed as a one-piece assembly which in this regard helps to eliminate leaks. It can be fabricated from a rubberized injection molded vinyl. Formed into the cover are two built in handles to provide ease in handling, both for installation and removal.

Tie-downs are also molded into the cover to provide ease in securing the cover to the craft. With a safer, more secure fit, the removal, installation and storage is much more convenient to the user. A secure fit helps to eliminate rotten floor boards in the bottom of a dinghy. Also, a secure formfitted construction eliminates the need to pump out water before use.

Long term exposure to ultraviolet rays from the sun is very damaging to materials that have been exposed for a long time. The materials used in this cover are formulated to be resistant to the damage that can occur from the exposure to ultraviolet rays.

The use of this cover protects the contents of the dinghy; there is no particular need to unload the dinghy after each use. The cover is also designed to be shaped so that the outboard motor can remain on the dinghy undisturbed.

In an alternative embodiment, the cover can also be made of a lightweight fiberglass material or even from a lightweight composite material.

In still another embodiment, the cover can be constructed of a foam material covered with a thin skinned plastic sheet. The plastic skin is waterproof and protects the inner core from being saturated with water. The cover being constructed from such lightweight materials offer two distinct advantages. They are: (1) that the cover is buoyant and cannot be easily lost at sea and (2) because of its conformal close fitting design to the hull of the craft offers a watertight integrity even if it capsizes when it is being towed.

What is now known as the "principle of Archimedes" states that the buoyant force is equal to the weight of that body of the fluid which the submerged body displaces, and may be treated as a single force acting vertically upward through the center of gravity of the displaced fluid. This buoyant force provides the familiar lifting effect of a fluid on a body that is wholly or partially submerged.

In this application, the cover is designed to have a lower mean density than the liquid, causing it to "float," partly submerged to a level, and in a position with reference to the vertical, as determinedly the Archimedes principle.

Yet in another embodiment these covers can also be designed to include other dinghy shapes and sizes. In particular these shapes can be extended to include inflatable dinghies, small fishing boats and even small jet boats Costs being a consideration in using this newly designed boat coat, the cost is estimated to be very competitive to presently available material or fabric coverings.

The ease of use encourages more use especially from those who are new to the field—thus increasing the interest in the use of dinghies, thereby extending the useful life of the dinghy.

It is therefore an object of this invention to provide for a conformable protective dinghy cover, constructed of a semi-rigid rubberized compound, that is manufactured by an injection molding process.

It is another object of this invention to provide for a conformable protective dinghy cover that has handles and tie-downs integrally molded in a one-piece construction.

It is still another object of this invention to provide for a conformable protective dinghy cover so designed to allow an outboard motor to remain mounted on the dinghy, when not in use.

Other objects and features of this invention will be apparent in part and so indicated hereinafter. Further advantages will be apparent to those of ordinary skill in the art upon reading and understanding the following detailed description.

DETAILED DESCRIPTION OF THE PREFERRED EMBODIMENT

Figure 1:
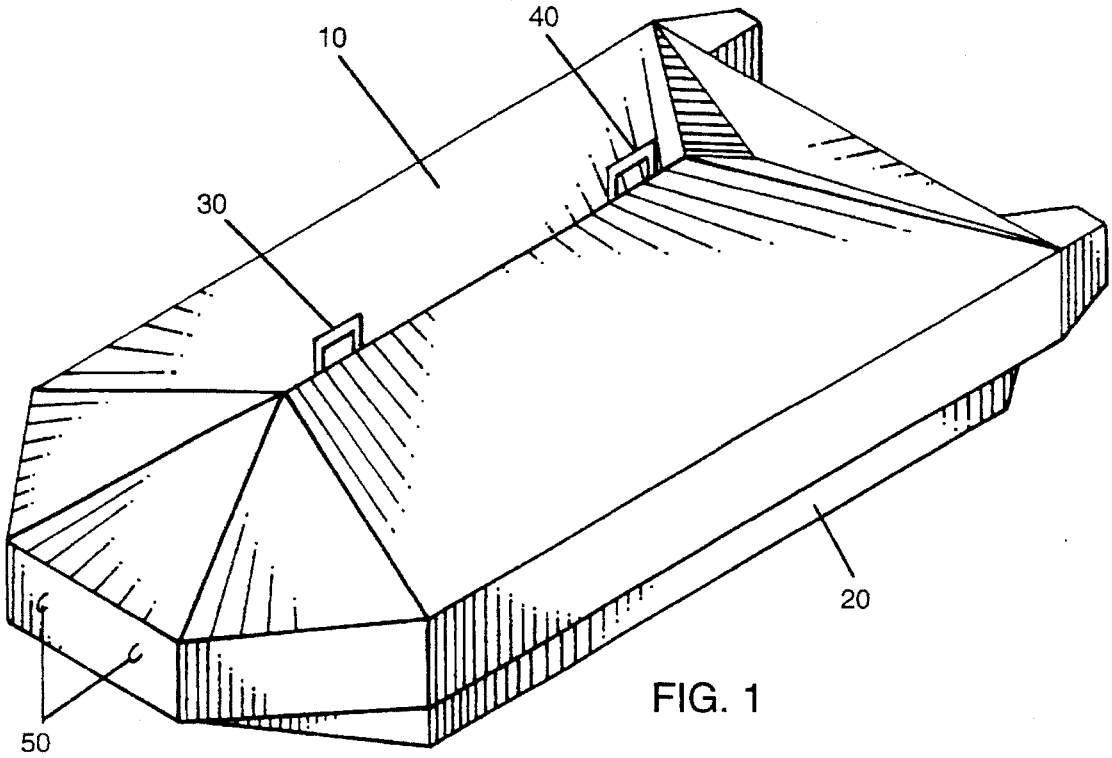
FIG. 1 is a perspective drawing showing the conformable protective dinghy cover means covering a dinghy.

Referring to the drawing FIG. 1, the conformable protective dinghy cover 10 is shown mounted on dinghy 20. The dinghy cover 10 conforms to the shape of the dinghy 20 to provide protection to the bottom of the dinghy and its contents. In good boating weather, the cover provides protection from water splashing into the interior of the dinghy, especially when it is in tow by another vessel. The wooden floor used in many dinghies is protected from rotting out when exposed to splashing water.

The cover is made from a durable rubberized vinyl plastic that was injection molded to produce a uniform product. The plastic used in producing these covers is specially formulated to protect for degradation from the intense and harmful ultraviolet rays. Because it is lightweight it can easily be mounted or dismounted by one person.

Handles 30 and 40 are molded into the body of the cover to produce a one-piece protective cover. This unitized one-piece construction is labor saving because there are no added costs associated with the assembly of the cover. Also, a unitized cover obviates the need to purchase or place into inventory small parts or subassemblies that are easily lost or frequently not ordered.

Figure 2:
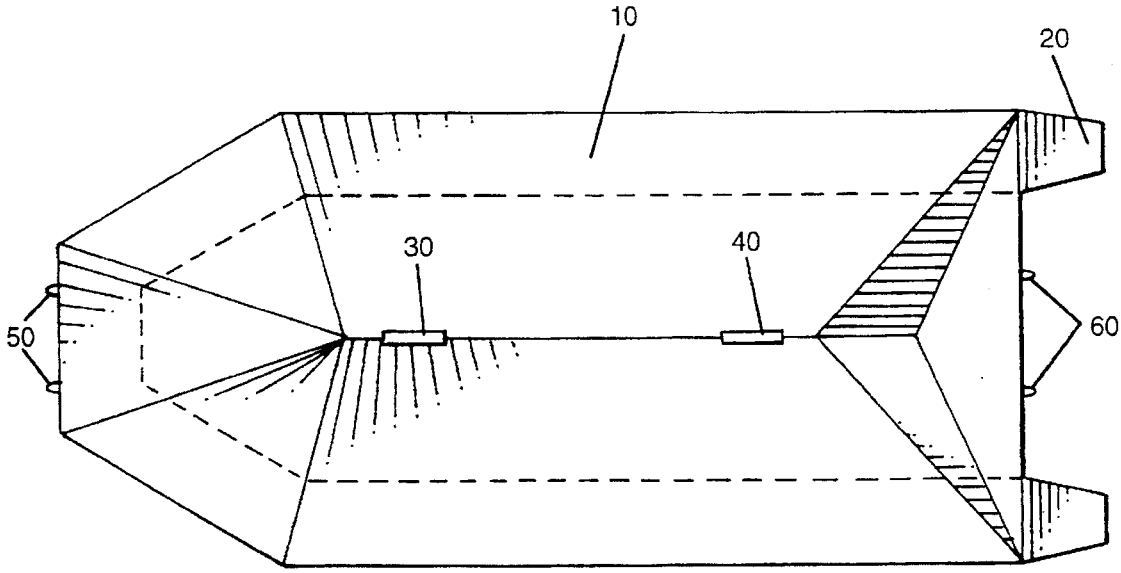
FIG. 2 is a top view of the conformable protective dinghy cover.

FIG. 2 shows the top view of the conformable protective dinghy cover 10 as it is installed on top of the dinghy 20. Handles 30 and 40 are placed conveniently on the top section of the cover to provide a well balanced positioning to aid the user when installing or removing the protective cover.

Figure 3:
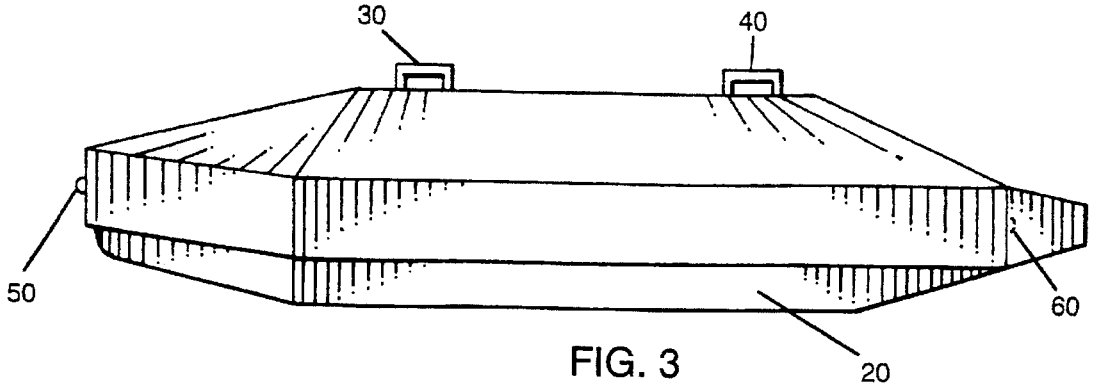
FIG. 3 is a side elevation of the conformable protective dinghy cover, shown mounted on the dinghy.

FIG. 3 is the side view of the installed cover 10. Handles 30 and 40, shown on the top of the cover, provide the user with well balanced positioning to aid in the installation or removal of the cover. A front bonnet 55 extends downward from a center triangular plane of the cover and a rear bonnet 63 extends downward from a third or aft plane of the cover. Tie-downs 50 are preferably molded in the front bonnet 35, while rearward tie-downs 60 are molded in the rear bonnet 65 to provide a means of securing the protective cover to the craft 20.

Figure 4:
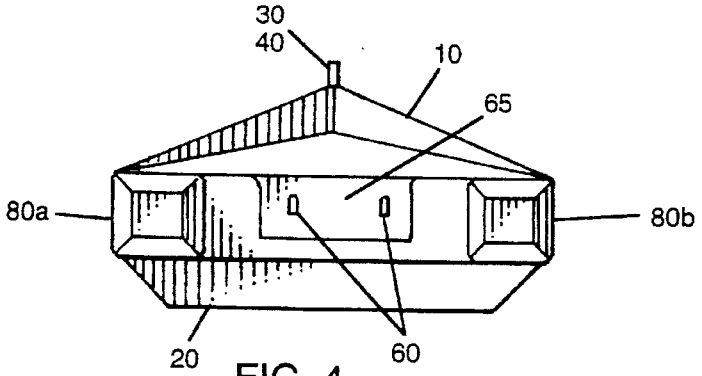
FIG. 4 is a rear elevation of the conformable protective dinghy cover.

The rear view is shown in FIG. 4. Tie-downs 60, molded into the cover, provides a convenient means of securing the cover. Outer walls **80*a* and 80*b*** are constructed as a pair of essentially semicircular outer covers or cover walls. Each of the pair of outer cover walls is integrally formed from assembly material and descends downward from a sidewall to form fit around the outer shell of the craft, thereby forming an essentially water-tight, secure compartment of the craft.

Figure 5:
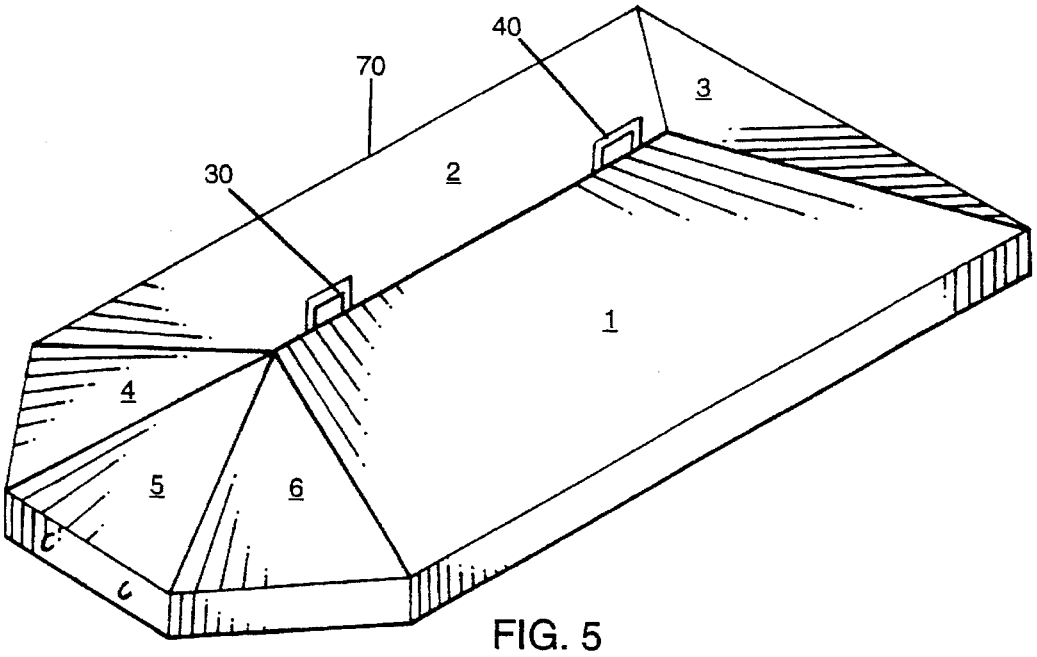
FIG. 5 is a perspective drawing showing an alternative embodiment whose configuration allows the aft plane to be in relief to accommodate an outboard motor.

Shown in FIG. 5 is an alternative embodiment of a protective cover 70. In this configuration, there are six sloping planes that converge at the apex of an elongated pyramidoidal shaped cover. Again the sloping panel prevent the collection of water, where it can runoff, thereby protecting the interior and contents of the dinghy. Planes 1 and 2 converge at the apex, meeting at the center to allow for runoff, forming a streamlined cover.

Figure 7:
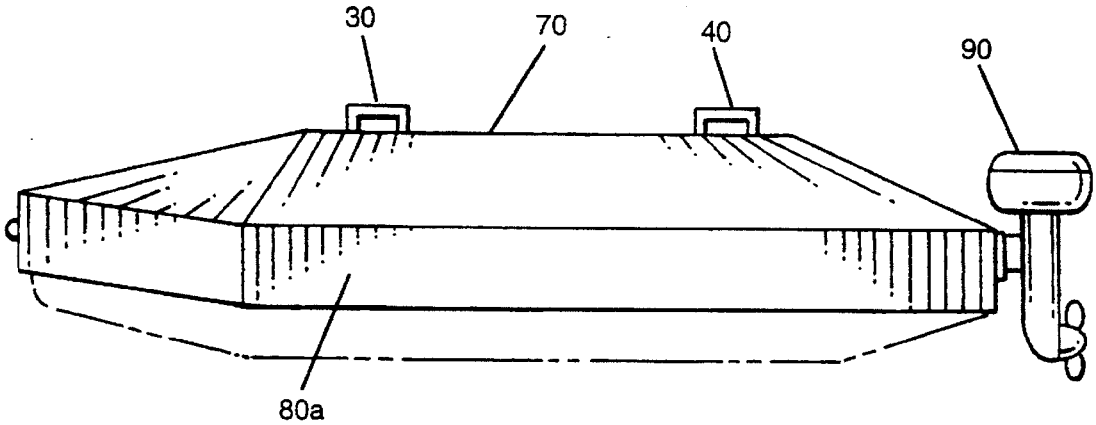
FIG. 7 is a side elevation of the protective cover shown in FIG. 6, which shows the outboard motor mounted in the relief area of the cover.

The aft plane 3 is relieved to accommodate an outboard motor 90. Plane 3 is sufficiently inclined to provide an easy installation without the need for removing the outboard motor. The placement of the outboard motor 90 is shown in FIG. 7 where it is normally secured to the aft end of the dinghy. The cover merely slips into the crevice beneath the overhanging outboard motor.

Added tie-downs are recommended for securing the protective cover to the dinghy 20. Handles 30 and 40 are molded into the cover and are placed so that the cover is balanced for ease of placement by one person. The handles are located at the peak of the upper most surface of the protective cover.

Figure 6:
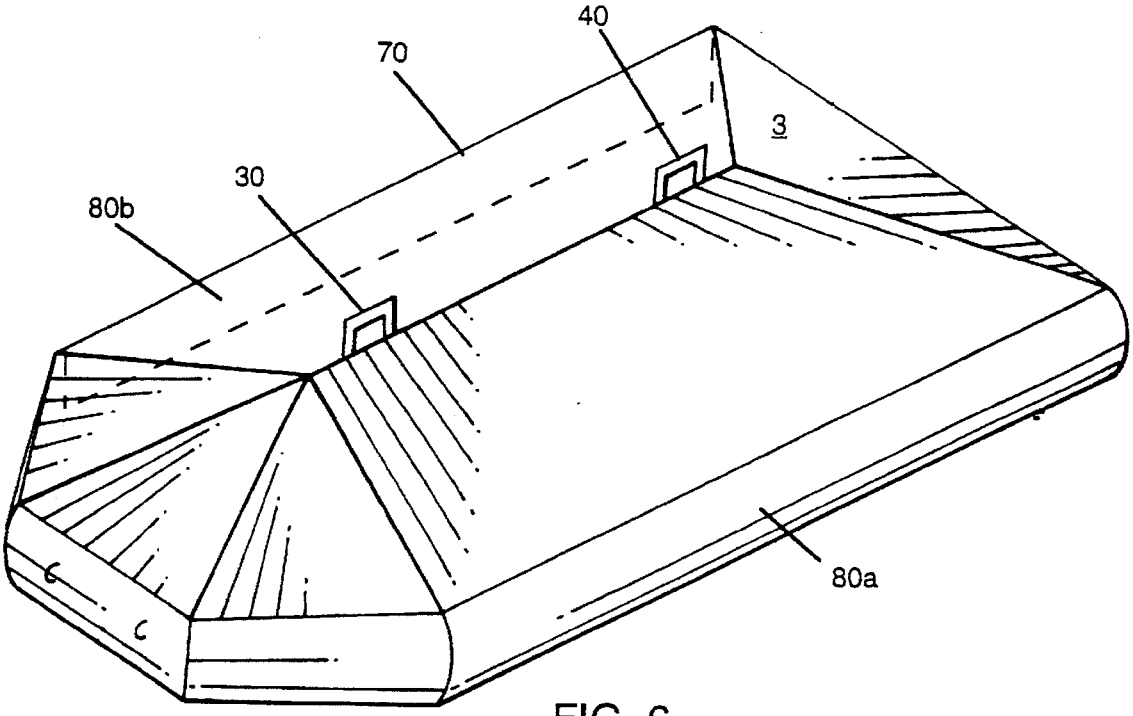
FIG. 6 is a perspective drawing showing still another embodiment of a protective cover which provides outer cover side walls that fit snugly around the outside shell of the dinghy.

FIG. 6 shows conformal side walls that are added to the configuration shown in FIG. 5. These outer cover side walls fit snugly around the outside shell of the dinghy, thereby maintaining an essentially watertight design for this cover.

What is claimed is:

1. A protective cover for small water craft, comprising:

a one-piece assembly formed of a semirigid material and adapted to cover small water craft; a plurality of handles integrally formed of assembly material for ease of handling the assembly in installation and removal; a plurality of tie downs integrally formed of assembly material for ease in securing the cover to the craft; the assembly has a tent-like shape with a plurality of upwardly ascending gable walls which converge at an apex of the assembly; the water craft has a longitudinal axis which extends from a bow to a stern of the craft and the apex of the assembly is essentially parallel to the longitudinal axis of the craft; each of the plurality of handles is positioned on the apex of the tent-like assembly; the assembly comprises six upwardly ascending planes which converge at an apex for a streamlined shape of the cover to facilitate runoff of snow and water for elimination of pockets of stagnant water; each of the six planes forms a sloping gable wall comprising two sidewalls, three front walls and a rear transom; the cover is fabricated from rubberized injection molded vinyl; each of the plurality of handles is molded into the body of the cover; a front bonnet descending downward from one of the three front walls and a rear bonnet which descends downward from the rear transom; each of the plurality of front tie-downs is positioned on the front bonnet and each of the plurality of rear tie-downs is positioned on the rear bonnet; the water craft has an outer shell, and the cover assembly further comprises a pair of essentially semicircular outer cover walls, each of the pair of outer cover walls integrally formed from assembly material and descending downward from a sidewall to form fit around the outer shell of the craft to form an essentially water-tight, secure compartment of the craft; the rear transom wall dives downward from the apex in a descending plane for sufficient relief to accommodate and avoid spacial interference with an outboard motor of the craft; wherein each of the plurality of tie-downs is molded into the cover to provide a convenient means to secure the cover; and, wherein the cover is fabricated with a core comprising a foam material.

2. A small watercraft protective cover, comprising:

a free standing molded piece adapted to cover small water craft;

a plurality of handles integrally formed with the molded piece for ease of handling the cover in installation and removal; and, wherein the piece has a tent-like shape with a plurality of upwardly ascending planar gable walls which converge at an apex of the piece.

3. The protective cover of claim 1, further comprising a plurality of tie downs integrally formed with the molded piece for ease in securing the cover to the craft.

4. The protective cover of claim 3, wherein the water craft has a longitudinal axis which extends from a bow to a stern of the craft and the apex of the molded piece is essentially parallel to the longitudinal axis of the craft.

5. The protective cover of claim 4, wherein each of the plurality of handles is positioned on the apex of the tent-like piece.

6. The protective cover of claim 3, wherein the piece comprises six upwardly ascending planes which converge at an apex for a streamlined shape of the cover to facilitate runoff of snow and water for elimination of pockets of stagnant water.

7. The protective cover of claim 6, wherein each of the six planes forms a sloping gable wall comprising two sidewalls, three front walls and a rear transom.

8. The protective cover of claim 7, wherein the cover is fabricated from rubberized injection molded vinyl.

9. The protective cover of claim 8, each of the plurality of handles is inflexible.

10. The protective cover of claim 9, further comprising a front bonnet descending downward from one of the three front walls and a rear bonnet which descends downward from the rear transom.

11. The protective cover of claim 10, wherein each of the plurality of front tie-downs is positioned on the front bonnet.

12. The protective cover of claim 11, wherein each of the plurality of rear tie-downs is positioned on the rear bonnet.

13. The protective cover of claim 12, wherein the water craft has an outer shell, and the cover piece further comprises a pair of essentially semicircular outer cover walls, each of the pair of outer cover walls integrally formed with the molded piece and descending downward from a sidewall to form fit around the outer shell of the craft to form an essentially water-tight, secure compartment of the craft.

14. The protective cover of claim 13, wherein the rear transom wall dives downward from the apex in a descending plane for sufficient relief to accommodate and avoid spacial interference with an outboard motor of the craft.

15. The protective cover of claim 14, wherein each of the plurality of tie-downs is inflexible.

16. The protective cover of claim 2, wherein the cover is fabricated from a material comprising fiberglass.

17. The protective cover of claim 2, wherein the cover is fabricated from a lightweight composite material.

18. The protective cover of claim 2, wherein the cover is fabricated with a core comprising a foam material.

19. The protective cover of claim 1, wherein the core is covered with a material comprising thin skinned plastic.

20. The protective cover of claim 19, wherein the plastic material covering the core comprises a waterproof sheet.

21. The protective cover of claim 20, wherein the cover further comprises a means for easy recovery from a water medium.

22. The protective cover of claim 21, wherein the means for easy recovery comprises the cover having a density and the density of the cover is less than the density of water displaced by the cover when said cover is immersed in water.

23. A small watercraft protective cover comprising a one-piece, stand alone structure having first, second, third, fourth, fifth and sixth sloping planes which converge in an apex to form an elongated pyramidoidal shaped cover that is formed of a semirigid, molded material; and, a plurality of handles integrally formed with the cover.

24. A protective cover according to claim 23, wherein the first and second planes converge at the apex for formation of a streamlined cover to allow for runoff of snow and water.

25. A protective cover according to claim 24, wherein the third plane intersects the first and second planes to form an aft transom which is relieved to enable easy installation of the cover without removal of an outboard motor for the craft.

26. A protective cover according to claim 25, further comprising a first outer side wall which depends and extends downward from the first plane and a second outer side wall which depends and extends downward from the second side wall.

27. A protective cover according to claim 26, wherein the first and second outer side walls each have a semicircular shape.

28. A protective cover according to claim 27, wherein a rear bonnet extends downward from the aft transom.

29. A protective cover according to claim 28, wherein the fourth plane comprises a sloping right front triangular plane; the fifth plane comprises a center front triangular plane; and, a sixth plane comprises a left front triangular plane; and, each of said fourth, fifth and sixth planes arises from a front portion of the craft to converge with the first and second planes at the apex.

30. A protective cover for small water craft, comprising a first, second, third, fourth, fifth and sixth sloping planes which converge in an apex to form an elongated pyramidoidal shaped cover; the first and second planes converge at the apex for formation of a streamlined cover to allow for runoff of snow and water; the third plane intersects the first and second planes to form an arm transom which is relieved to enable easy installation of the cover without removal of an outboard motor for the craft; further comprising a first outer side wall which depends and extends downward from the first plane and second outer side wall which depends and extends downward from the second side wall; wherein the first and second outer side walls each have a semicircular shape; wherein a rear bonnet extends downward from the aft transom; the fourth plane comprises a sloping right front triangular plane; the fifth plane comprises a center front triangular plane; and, a sixth plane comprises a left front triangular plane; and, each of said fourth, fifth and sixth planes arises from a front portion of the craft to converge with the first and second planes at the apex.

31. A protective cover according to claim 30, further comprising a front bonnet which extends downward from the center front plane.

* * * * *